US005747714A

United States Patent [19]

Kniest et al.

[11] Patent Number: 5,747,714

[45] Date of Patent: May 5, 1998

[54] DIGITAL TONE SYNTHESIS MODELING FOR COMPLEX INSTRUMENTS

[75] Inventors: James Kniest, Edmonds; Jay Dee Petersen, Seattle, both of Wash.

[73] Assignee: James N. Kniest, Edmonds, Wash.

[21] Appl. No.: 558,362

[22] Filed: Nov. 16, 1995

[51] Int. Cl.[6] ..... G10H 7/00

[52] U.S. Cl. ..... 84/604; 84/625; 84/660

[58] Field of Search ..... 84/603–607, 609–610, 84/622–625, 659–660

[56] References Cited

U.S. PATENT DOCUMENTS

| | | | |
|---|---|---|---|
| 4,149,440 | 4/1979 | Deforeit | 84/1.01 |
| 4,177,707 | 12/1979 | Boucher | 84/1.01 |
| 4,279,185 | 7/1981 | Alonso | 84/1.01 |
| 4,433,604 | 2/1984 | Ott | 84/1.19 |
| 4,440,058 | 4/1984 | Bass et al. | 84/1.26 |
| 4,493,237 | 1/1985 | DeLong et al. | 84/1.26 |
| 4,554,855 | 11/1985 | Alonso et al. | 84/122 |
| 4,638,706 | 1/1987 | Nagashima et al. | 84/1.01 |
| 4,649,783 | 3/1987 | Strong et sl. | 84/1.01 |
| 4,709,611 | 12/1987 | Takagi et al. | 84/1.22 |
| 4,736,663 | 4/1988 | Wawrzynek et al. | 84/1.26 |
| 4,991,218 | 2/1991 | Kramer | 381/61 |
| 5,103,711 | 4/1992 | Iwase | 84/660 |
| 5,111,727 | 5/1992 | Rossum | 84/603 |
| 5,157,214 | 10/1992 | Nakanishi et al. | 84/622 |
| 5,157,218 | 10/1992 | Kunimoto | 84/659 |
| 5,220,117 | 6/1993 | Yamada et al. | 84/600 |
| 5,229,536 | 7/1993 | Kunimoto et al. | 84/658 |
| 5,241,127 | 8/1993 | Kobayashi | 84/616 |
| 5,241,129 | 8/1993 | Muto et al. | 84/625 |
| 5,250,748 | 10/1993 | Suzuki | 84/661 |
| 5,268,528 | 12/1993 | Iwase | 84/660 |
| 5,304,734 | 4/1994 | Kunimoto | 84/661 |
| 5,354,948 | 10/1994 | Toda | 84/624 |
| 5,376,752 | 12/1994 | Limberis et al. | 84/622 |
| 5,468,906 | 11/1995 | Colvin, Sr. et al. | 84/625 |

*Primary Examiner*—Brian Sircus
*Assistant Examiner*—Marlon T. Fletcher
*Attorney, Agent, or Firm*—Patrick M. Dwyer

[57] ABSTRACT

A tone synthesizer for complex tone modeling, synthesis, or reproduction for simple to complex instruments, both real and imagined. The tone synthesizer has a wave generator that is responsive to a key signal from a key signal generator to produce an analog or digital wave. The key signal corresponds to a discrete musical note value. A preferred digital wave generator for a digital tone synthesizer is a DSP with componentry to read from a digital memory, generally a large RAM, one or more previously recorded, or sampled, digital waveforms loaded to the RAM. The digital wave generators selectably respond to a key signal to produce a primary note output in the from of a digital wave, or to a sympathetic note signal from a sympathetic note signal generator to produce a sympathetic digital wave. The sympathetic note signal generator is preferably responsive to at least one sympathetic note signal generator input to produce the sympathetic note signal, and can produce multiple sympathetic note signals to multiple digital wave generators. The digital wave generator producing the primary note output digital wave and the digital wave generator producing the sympathetic digital wave cooperate to produce a summed digital wave output which is the digital sum of the primary digital wave and one or more of the sympathetic digital waves.

Also a digital tone synthesizer has stored digitally sampled note data, the note data having been sampled at a sampling frequency F, with a sample period of 1/F, and has a DSP clock operating at a DSP clock frequency; a slot count incrementer for incrementing in a slot counter a slot count of a selectable number of slots n, each slot having a slot duration defined by a selectable number of DSP clock ticks T. It also has a system clock producing system clock ticks and operating at a system clock frequency equal to a whole number multiple P of the sampling frequency. It also has a reset counter for counting P system clock ticks and thereupon effecting a reset signal to the slot counter.

6 Claims, 9 Drawing Sheets

DIGITAL TONE SYNTHESIS MODELING FOR COMPLEX INSTRUMENTS

TECHNICAL FIELD

The invention relates to the field of musical tone reproduction, synthesis and modeling; more particularly, it relates to method and apparatus for synthesizing or modeling a tone for a complex musical instrument, such as a grand piano, particularly in the digital domain.

BACKGROUND OF THE INVENTION

Digital tone synthesis modules are known and used as adjuncts to electronic musical recording facilities, and to a growing number of performance venues. Raymond Kurzweil, a pioneer in music synthesis, has said of piano synthesizers that in the future, "a digital piano will sound better than an upright piano, because the digital piano is modeled on a grand piano." (The first piano mechanism was built in 1771 and included a linkage that made the volume of the sound produced proportional to the force applied to the key. With one major modification in 1823 to enhance quicker key action, modern grand pianos remain the same as at the beginning.)

After some early attempts to "synthesize" the sounds of complex instrument such as a piano via conventional electronic synthesis methods (usually variations on additive or subtractive synthesis techniques), it became virtually axiomatic that no synthesizer could produce a sound that could possible be mistaken for a real instrument, especially a grand piano. To this axiom, some demurred, why not use a real acoustic instrument if a real sound was what was wanted? The reason is that an electronically produced instrument sound can be so much more modified and controlled, and in ways that would be impossible with its acoustic counterpart.

As to the piano in particular, it may be borne in mind that its sound is exceptionally complex, resulting from a system with over 200 strings, many of which are undamped, and none of which are perfectly damped, to say nothing of soundboard, case and keyboard, each of which is composed of complex natural fibrous materials with their own unique vibrational modes and resonances. There are also many compromises in how any given piano is tuned, requiring that some octaves be shifted slightly, partials stretched to make the instrument sound "acceptable" in all keys, and the like. The piano also covers the widest range of pitches of any instrument, and its sound is very familiar to many if not all listeners.

Kurzweil himself has enjoyed considerable success in producing convincing piano sounds with his Kurzweil model 250 digital synthesizer, and its successors, where the current state of the art involves the use of actual "sampled" musical notes. That is, an instrumental note is played (for instance on a real piano) and simultaneously digitally sampled, or recorded, to a digital storage medium (such as disk or RAM or ROM). The note is sampled at a sampling rate (typically 44.1 KHz or so-called "CD sample rate"), and for a duration, the length of which is usually a compromise necessitated by the large storage requirements of CD rate samples.

Another inevitable compromise is that, for instruments with a great range of possible note values, and many subtle variations possible for each note, only some of the large number of possible instrument note sounds are sampled. It appears to be known to sample at least some of those limited number of note samples at more than one dynamic level (i.e. sampled at both piano and forte dynamic levels to capture the harmonic differences attendant in the instrument when a particular note is played at different dynamic levels), and, in the case of the Kurzweil instrument, to use proprietary compression algorithms with dynamic value containing exponents to reduce storage requirements. But for the reasons outlined above, what is needed is at least one full sample of every note from the keyboard, not just a frequency or octave shifted clone of another note. Attempts to effect harmonic difference simulation from soft to hard key strikes similarly do not work well. Even dynamic cross-fade type mixing of samples of a piano sampled note with a forte sampled note to produce a simulated mezzo forte note fail because of a slight pitch shift in the transition between piano and forte. The slight difference creates an audible beat frequency.

To add to the difficulty facing modelers and simulators, since many of the notes of a grand piano will sustain (with key(s) or pedal down, and some without regard to damping effects as indicated above) for very long periods of time, and in fact are actually played that way by piano performers of (for instance) classical music, a current electronic sampling technique is to record only the beginning of the note sound (i.e., the attack portion of the sound envelope, and perhaps some of the early decay and harmonics) and then the beginning of the relatively stable and reduced dynamic level sustain). Then during playback, the early sustain portion of the sample is "looped" for as often as is required to simulate the real piano's capacity to so sustain the note. In addition, intervening notes (notes that occur in between available sampled notes in memory) are "interpolated" by slowing down or speeding up the closest available sample to achieve the appropriate note frequency. This leads of course to inaccuracies of synthesis in that there is generally much more in tonal and sound quality difference from one note to the next than just frequency, as discussed above, and the looping, even if expertly done to avoid glitches at the loop points, only barely approximates the actual sound of a sustained piano note, especially at lower frequencies.

In an acoustic piano a process referred to as sympathetic note generation adds further complexity. Playing a "primary" note, particularly at elevated dynamic levels, actually causes the string(s) of other notes to vibrate sympathetically to the vibration of the sounded note(s). For chordal play, and with notes sustained, the resulting sound is invariably unique not only to the brand of piano, but to the particular piano as well. Current electronic pianos do not even attempt to simulate this effect (except adventitiously in that a microphone recorded note sound will also pick up some portion of the naturally occurring sympathetic note vibration occurring elsewhere in the piano structure, though this kind of "extra" sound is exactly the kind of sound that the audio recording engineer typically works so hard to "reject", and even when left in the recorded sample is a kind of "frozen" artifact, in that the sympathetic component so recorded is either irrelevant to faithful modeling or simulation of a neighboring note, or actually—and to some extent, fatally—discordant).

Known electronic piano modules have limited simultaneous note output capacity (currently limited to between 16 and 32 simultaneously "played" notes). That is, if more than 16 (or 32) notes are being "played" (either pressed or sustained), including the sustain looping portion of the note envelopes, then some notes are simply not output at all. Most modules have selectable arrangements for determining which notes are not played or which notes are to be cut off, the most common of which is a variation on FIFO (actually a kind of "first-on-first-off"). This limitation stems partly from the fact that each note played or sustained requires in conventional systems its own synchronously dedicated "note generator".

What is needed is more control so that any or all (musically "real", or artistically contrived) sympathetic notes can be dynamically activated for a more accurate and more richly complex timbre. A more holistic approach also will produce a richer interaction between all notes being played. It would be desirable also to have the piano modifiable by the musician to determine optionally and selectively which notes are to be sympathetic with a particular primary and also how much any sympathetic note contributes (i.e. at what dynamic level and/or degree of frequency shift) upon activation. It would also be desirable to have sympathetic note operation individualized, so that, depending on which keys are down (and when the pedal is not depressed), only the held down notes are available to be played sympathetically. It would also be desirable for allowance to be made for dynamic augmentation of primary notes to account for and distinguish the primary note sound from those of the activated sympathetic notes (which may have as a component of their sound in some cases the same frequency as the primary note(s)).

DISCLOSURE OF THE INVENTION

It is an object of the invention to provide more control in a digital synthesizer so that any or all sympathetic notes can be dynamically activated for a more accurate and more richly complex timbre.

It is another object of the invention to provide a more holistic approach to digital synthesis to produce a richer interaction between all notes being played.

It is another object of the invention to have the digital tone synthesizer modifiable by the musician to determine selectively which notes are to be sympathetic with the fundamental, and also how much and of what kind any sympathetic note contributes upon activation.

It is yet another object of the invention to have sympathetic note operation individualized, so that, depending on which keys are down (and when the pedal is not depressed), only the held down notes are available to vibrate sympathetically.

It a further object of the invention to allow for dynamic augmentation of primary notes to account for and distinguish the primary note sound from those of the activated sympathetic notes (which will have as a component of their sound in some cases the same frequency as the primary note(s)).

It is yet another object of the invention to meet any or all of the needs summarized above.

These and such other objects of the invention as will become evident from the disclosure below are met by the invention disclosed herein.

The invention addresses and provides such a system. The invention represents in one aspect a digital tone synthesizer artful and useful for complex tone modeling, synthesis, or reproduction for simple to complex instruments, real or imagined. In preferred embodiments, the instrument modeled is a grand piano, and the tones synthesized are the complex harmonic mixtures produced by the piano strings in concert with one another. The invention makes use of, in its most generalized from, a digital wave generator that is responsive to a key signal from a key signal generator to produce a digital wave. The key signal will generally correspond to a discrete musical note value, typically one of the notes from one of the "western" "well-tempered" scales, but not necessarily. In the digital domain, scales from other parts of the world or even invented or experimental scales are possible too.

The key signal generator most preferably used will be a piano keyboard, but might also be the strings of a guitar or the valves of a horn. Preferred embodiments will employ a MIDI capable keyboard. The key signal most preferably used, especially in conjunction with MIDI keyboards, is a MIDI note number. Under the various implementation of MIDI, note velocity, note aftertouch and note release velocity, as well as basic note-on and note-off are all components of a MIDI note number sending, and are all possible components of the key signal of the invention, which, in addition to including a musical note value, can therefore also include a dynamic value (such as piano or forte or any of the MIDI note representations of dynamic value in between) for the musical note.

A preferred digital wave generator is a DSP (digital signal processor) with componentry to read from a digital memory, generally a large RAM, one or more previously recorded, or sampled, digital waveforms loaded to the RAM from media (such as CD or CDROM, or other relatively permanent digital mass storage means, such as optical disc, WORM or the like). The preferred digital waveforms are of musical notes produced on the instrument which is to be simulated or emulated. Other wave generators in musical tone synthesis are known however, and may be employed by those skilled in the art without departing from the scope of the invention. Preferred DSPs by their design will be capable of functioning as multiple digital wave generators, though more limited DSPs may be made to serve in the invention as well. The digital wave generators may be dynamically allocated as to which key signals they can and will respond to, and they are advantageously interchangeable in terms of responding to a key signal or to a sympathetic note signal. In preferred embodiments, each digital wave generator is dedicated to a particular key signal or set of key signals, although the digital wave generator will accept note signal input and generate a digital wave whether the signal is a key signal or a sympathetic note signal.

Some of the digital wave generators used in the invention selectably respond to a key signal to produce a primary note output in the from of a digital wave which is then converted to analog from, amplified, optionally mixed with other sounds and output through speakers. Other, or sometimes the same, wave generators are responsive to a sympathetic note signal from a sympathetic note signal generator to produce a sympathetic digital wave. The sympathetic note signal generator is preferably responsive to at least one sympathetic note signal generator input to produce the sympathetic note signal, and preferably produces multiple sympathetic note signals to multiple digital wave generators. Some of the contemplated sympathetic note signal generator inputs are note volume dynamic levels, static or user adjustable frequency shift variables, dynamic "notes-on", and a user set switch as to type of instrument to be simulated, and/or as to amount and number of any of the input types to be responded to.

The sympathetic note signal generator cooperates with a sympathetic note value generator to produce multiple sympathetic note signals in response to at least one sympathetic note signal generator input. In preferred embodiments, the sympathetic note signal generator has, or has access to, a look up table of note waveform data addresses in the digital memory, and the sympathetic note signal itself is a starting address of a particular string of note waveform data.

The digital wave generator producing the primary note output digital wave and the digital wave generator producing the sympathetic digital wave cooperate to produce a summed digital wave output which is generally the digital sum of the primary digital wave and one or more of the sympathetic digital waves.

A preferred sympathetic note signal generator produces multiple sympathetic note signals the number and values of which are produced in cooperation with a dynamic notes-on table, where the dynamic notes-on table dynamically stores all current note values corresponding to real-time key signal inputs from multiple key signal generators. In other words, the number and content of the sympathetic note signals from the sympathetic note signal generator is variable in response to the dynamic value component, or any other component, of the key signal, including producing, from the variable note volume dynamic component of the key signal through the sympathetic note signal generator, variable dynamic sympathetic digital waves.

It is contemplated that analog circuitry can be made to substitute, at least to some extent, for digital components disclosed herein, even to the extent that the tone synthesizer of the invention may functionally be capable of operating in the analog domain and without digital assistance, except possibly in control systems for the analog sound generating components, all without departing from the scope of the invention as disclosed herein.

The invention in another aspect is also a digital tone synthesizer having stored digitally sampled note data, the note data having been sampled at a sampling frequency F (and therefore having a sample period of 1/F), and having a DSP clock operating at a DSP clock frequency; a slot count incrementer for incrementing in a slot counter a slot count of a selectable number of slots n, each slot having a slot duration defined by a selectable number of DSP clock ticks T. It also has a system clock producing system clock ticks (in addition, if necessary, to any CPU system clock) and operating at a system clock frequency equal to a whole number multiple P of the sampling frequency. It also has a reset counter for counting P system clock ticks and thereupon effecting a reset signal to the slot counter. In preferred embodiments, the slot count incrementer stops when the slot count reaches the number n, and then waits and restarts when the slot count is reset to 0. One way contemplated to accomplish the incrementer stop is to have the reset counter count a whole number of DSP clock ticks equal to the value of the expression ($n \times T$). A preferred number of DSP clock ticks is 8 and the preferred DSP frequency is 40 MHZ. The slot count may advantageously include a note count and a coefficient count, and the preferred sampling frequency is 44.1 KHZ and the preferred number of slots n is 112, all as will be discussed in more detail herein.

The invention thus comprises hardware and software to simulate, in presently preferred embodiments, the sound of a world class grand piano. All 88 notes of a world class grand piano played in a high quality studio environment are sampled at 44.1 KHZ, including sampling of the full length of each sustained note. Samples are optionally taken of some or all of the notes at more than one dynamic level. All samples are conventionally optimized and then stored in ROM, and in CDROM, or some other permanent memory media.

A preferred "piano" system of the invention will be a PC based system using the PC CPU as the host processor. Conventional video and MIDI cards are preferably used. The principal piano hardware resides on two custom expansion bus modules: the DRAM Address Generator (DRAG) and the DSP modules. As suggested above, before playback of any samples, the invention provides for downloading from permanent memory a sample set (i.e. for a specific "piano") to RAM. Then, for basic playback of each note, the stored sample is simply accessed in RAM through the DRAG, processed through a DSP chip (optionally digitally mixed with other note outputs) and output through a D/A converter to the conventional analog section, as described above. To achieve shorter notes (or notes at lower dynamic levels) than as actually sampled, a from of conventional envelope shaping may also be employed in the DSP. As an alternative to enveloping a sound, digital subtractive synthesis may be applied to modify the sample output without departing from the scope of the invention.

To achieve the level of verisimilitude of actual grand pianos, the PC is preferably programmed with a look up table to also trigger defined "sympathetic" stored sampled notes based on the values in the look up table, which are then played back through the DSP's at appropriate volume and dynamic levels, to emulate musical acoustic principles with which the person skilled in the art will be familiar. Alternatively, sympathetic values may be chosen and activated based upon simple multiples of the fundamental of the primary note values played.

By means of the unique timing scheme referred to above, involving the two computer timing loops, and with at least 16 DSP's, it becomes possible to play and sustain (including sympathetic note triggering) all 88 key notes (and more) "simultaneously". That is, it will appear simultaneous to the human ear, in that human musical event perception is generally negligible in time intervals shorter than about 20 mS, and as set forth in more detail below, musical events in the apparatus of the invention begin, end, follow and/or are chained in time durations measured in nanoseconds. If, within a preferred total of 112 "time slots" having a total combined time duration of 22.4 μS, as many as 88 separate note sample data sequences are initiated, terminated or otherwise altered in the DSPs, each event spaced about 200 nS apart, the human ear will not be able to perceive the timing difference between a 1st note and an 88th note, the total maximum possible event timing difference being 22.4 μS or less. If each DSP can process as many as six concurrent note data sequences or streams, plus related intermittent "coefficient" data for each of the six notes, then 16 DSPs can "simultaneously" process at least 88 concurrently "playing" notes. The actual total possible number of simultaneously playing notes is much higher than 88, even with the limitations of current technology. The ultimate limit is dictated only by DSP practical operating frequency limits and the minimum number of nanoseconds needed for each slot "state", which even now could be much less than the 25 nS now allocated per DSP clock tick.

As alluded to above, one of the "loops" is preferably clocked at 44.1 KHz (corresponding with the general sampling frequency standard, though if other sampling frequencies are used, the timing of this loop can be and should be altered accordingly) to produce a clock period (or "clock") of approx 22.7 microseconds ($1/44.1$ KHZ=22.675 μS); the other loop is preferably clocked at 40 MHZ (to correspond with the operating frequency of preferred DSPs). The loop will have preferably 112 "slots" of 8 clocks each (combined period of 22.4 microseconds). Two of the slots are uniquely used as time within which to "refresh" the DRAM to guarantee against memory loss in continuous RAM access usage. Additional "slots" may be put to use, with changes to the DSP operation frequencies and slot size, as will be appreciated by those skilled in the art, and the chosen period leaves time for resynchronizing the two loops at the end of each sample period.

In preferred embodiments, a free standing "piano" embodiment of the invention is further comprised of conventional grand piano components (such as cabinetry, keyboard, etc.) or alternatively employs a conventional electronic keyboard. In either case, optional analog audio processing, amplification, and speaker transducers are included. In one embodiment (based on a "real" grand piano), a large scale LCD monitor is substituted for the conventional music desk and may selectably be used to hold conventional paper sheet music, or to display sheet type notation from a conventional computer program that displays and scrolls musical notation.

BEST MODE OF CARRYING OUT THE INVENTION

Figure 1:
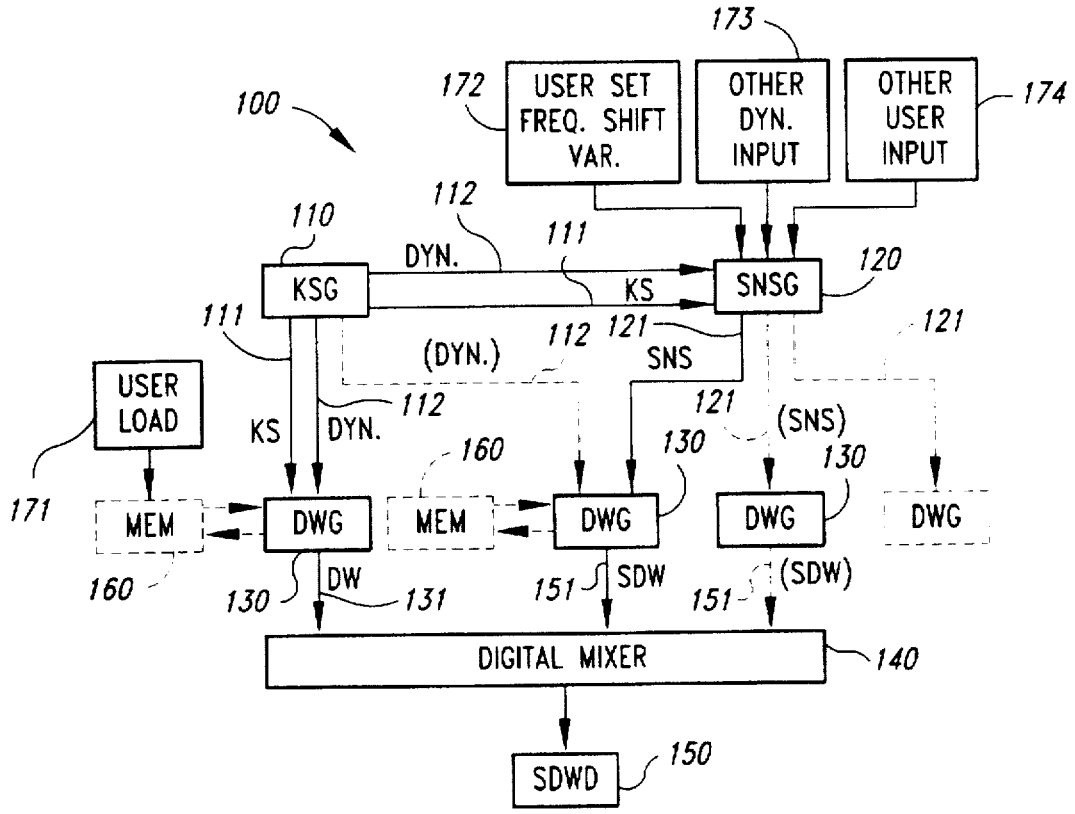
FIG. 1 is a block diagram of one aspect of the invention.

A preferred embodiment of the invention will have one DRAM address generator module or DRAG (also sometimes simply referred to herein as the address generator or AG) with 2 to 3 DRAM daughter cards attached. It will also have four DSP modules, together with a PC compatible computer (386/486 minimum) with 8 conventional PC bus expansion slots (ISA or better), a MIDI card, a serial control port, SCSI interface, power supply, control panel, and monitor.

The DRAG module will preferably comprise a 7 bit note number address generator, a 19 bit note sample address generator, a DRAM controller, conventional address muxing, conventional RAS/CAS (row column address) generation, a slot count generator, a conventional PC bus interface (ISA or better), clock sources for 40 MHZ and for 11.290 MHZ TTL system clocks, 32 Mbytes DRAM on each board, with 3 DRAM section daughter cards preferred per system (DRAM arranged as 64 notes×512 k per note 16 bit samples—generally enough for 11 to 22 seconds of audio), and read/write access from the CPU host.

Each DSP module board will preferably have four Motorola 56002 DSP processors with local 8 k×24 bit wide SRAM for each DSP, output for digital data using standard AES/EBU transmitters (CS8402A), a NoteBus interface, conventional PC bus interface, and bidirectional data buffers on the CoefBus for communication with the host CPU.

In any of the embodiments disclosed herein, any or all of the sympathetic notes activated may be so activated, in whole or in part, based on a dynamic level input, such as the dynamic level of the activated primary note that "calls" the respective sympathetic notes. Other dynamic level inputs might be static or dynamic, user set constant, or user variable dynamic level controls, such as MIDI sliders and the like, all for more accurate and/or more varied and complicated timbre synthesis. Sympathetic notes for any given primary can be selected from either preestablished look up tables, or calculated on the fly. For instance, octaves are choices for sympathetic notes. Other choices may be made based on sound pressure graphing, and the like. Regardless of which notes are preset for activation as sympathetic notes with respect to given primaries, the user or musician can modify which notes are to be sympathetic at any given time and under any given circumstances, or even just improvisationally, and any sympathetic note can be modified as to its percent contribution to the whole primary/sympathetic sound mixture. It bears mention that the invention's concept of sympathetic notes goes much farther than merely depressing the damper pedal (or the electronic equivalent thereof) to sustain more notes than those with keys actually depressed. Sympathetic note setups can allow for no sympathetic notes, only one or a few sympathetic notes (for instance, only from among those note keys that are currently depressed), or any number of possibilities.

Figure 5:
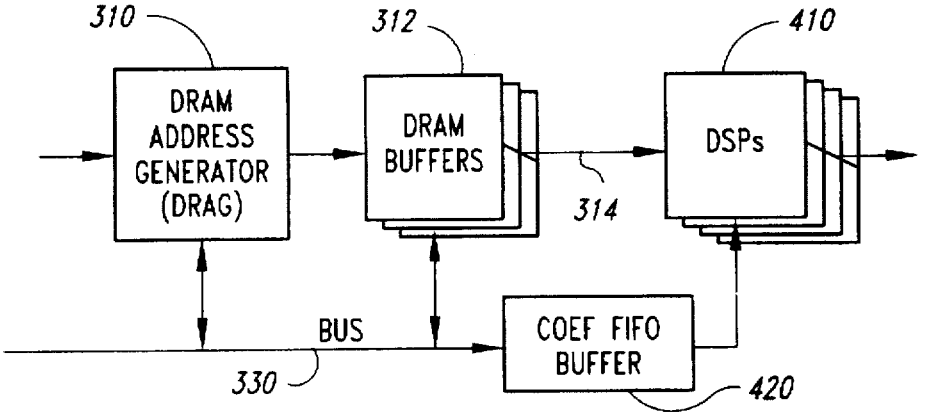
FIG. 5 is a block diagram of data flow in one aspect of the invention.
Figure 13:
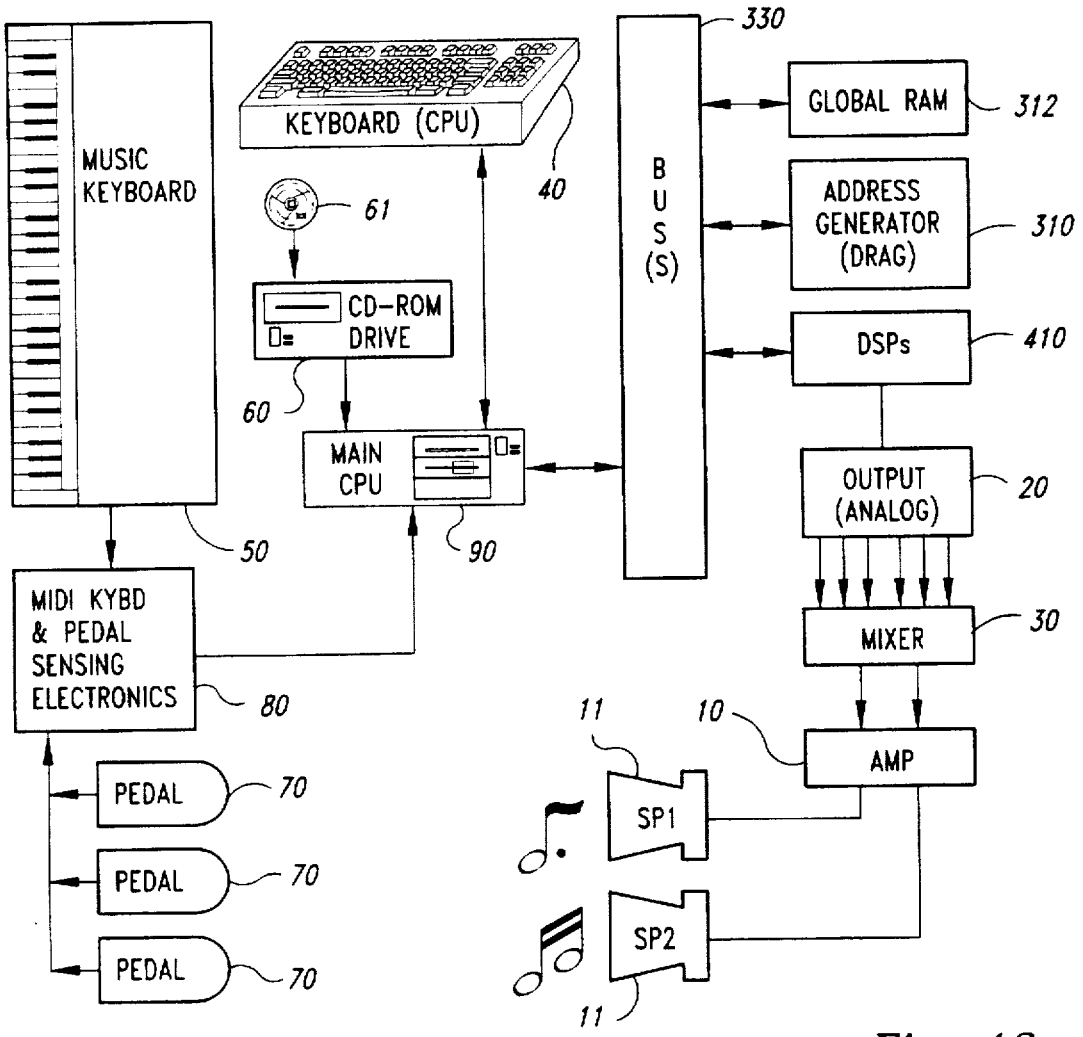
FIG. 13 is a system block diagram for the invention.

Turning now to the drawings, wherein like numbers indicate like parts, preferred embodiments of the invention are disclosed. In operation the system will function as described below. The block diagram of FIG. 5 illustrates the custom modules' data flow, while the block diagram of FIG. 13 illustrates the general flow of data and control in the invention as a whole. The host CPU (or Host) 90 is responsible for accepting and parsing MIDI commands from the MIDI keyboard 50 and pedals 70 through the MIDI electronics 80. Once the necessary information for a particular note has been determined from the MIDI codes, Host 90 will also send the appropriate coefficient data (or Coef) comprised of filter coefficients and envelope data, all as will be appreciated by those skilled in the art, to the DSP 410 corresponding to the activated note. Coefficient data will be written to the Host bus interface 330 (sometimes referred to herein as a CoefBus) and buffered in a FIFO 420 (one FIFO for each DSP). When the last byte of Coef data has been written to the Coef buffer for a particular note activation, a start code will be sent to the address generator 310 to initiate the transfer of note data from the DRAM buffers 312 (sometimes referred to herein as the RAM Array or RAMA) to the DSPs 410 by sending a starting address to DRAM and thereby causing the DRAM to begin to read out note data to the DSPs along a note data bus or NoteBus 314. In some embodiments, Notebus 314 may be part of Host bus 330.

The DSPs 410 then output digital audio to analog output section 20 which includes conventional DAC. From there the analog audio output is conventionally mixed in mixer 30, fed to amplifier(s) 10 and output to speakers 11. Host CPU 90 also has input from conventional CPU type keyboard 40 and mass storage access to CDROM drive 60 with removable CD's 61.

Figure 10:
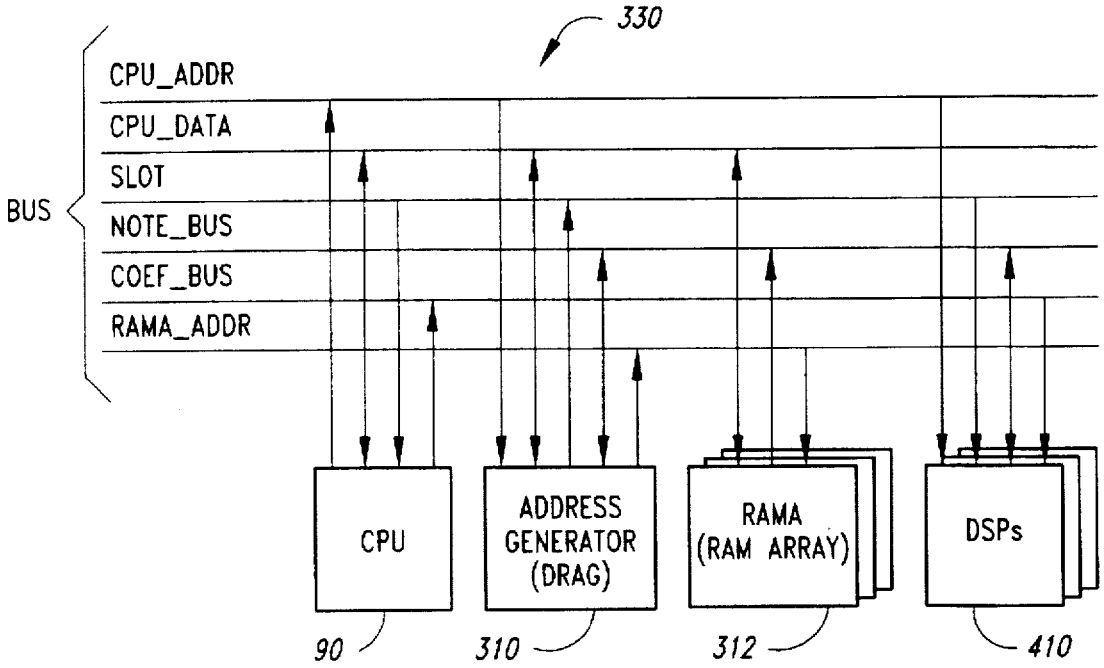
FIG. 10 is a schematic block diagram of an alternate bus data flow for the invention.

FIG. 10 is a block diagram of an alternative data path set up. Bus 330 is comprised of subcomponent buses CPU_ADDR, CPU_DATA, SLOT, NOTE_BUS, COEF_BUS, and RAMA_ADDR. Each of the functional blocks of the invention, CPU 90, DRAG 310, RAMA 312, and DSPs 410 communicate through lines to the appropriate bus and sub-buses as illustrated.

In operation, the DRAG 310 continuously cycles through all possible note numbers, waiting for a start indication. When the software decides it's time to turn on a new note (see FIG. 11), coefficient data is written through the Coef FIFO 420 to the DSP 410 which will be processing the new "event". Key presses and key releases are two separate events. The DRAG 310 then provides addresses to the note storage DRAM 312 to retrieve samples for activated notes. The DRAM array 312 may be advantageously thought of as two-dimensional; one axis for the notes (96 total notes available in a preferred embodiment) and the other axis for the samples for each note (512 k 16-bit samples for a preferred design). When a note is activated, the AG 310 will sequence through that note's stored sample data, and the note data will be sent to the DSP modules 410. For a given active note, a new sample is sent to the DSP module every sample period of approximately 22.7 μS (at the preferred 44.1 KHz sample rate).

As indicated, during note time (see time slot definition discussion herein), note data is transferred to the appropriate DSP processor 410 on NoteBus 314. Note samples are initially written into DSP internal memory via the host port (also see FIG. 8). Each DSP processor reads note data "on demand"; that is the DSP 410 goes to its FIFO 420 for new data as it finishes processing of old data, and this read may be synchronous or asynchronous. It depends adventitiously on the timing of the arrival of note data. The DSP modules then filter, scale, and mix the incoming active notes. Once all processing has been completed, the mixed samples are sent to the output module 20.

In addition to preferred hardware and software aspects of the invention, it is also beneficial to view the invention as a set of preferred constructs for digital (or analog, for that matter) tone synthesis, based on interoperable virtual machines. That is, in at least some preferred embodiments, any given piece of hardware, such as DSP chip, may function as one or more virtual machines in the operation of the invention; at the same time, any particular "machine" construct may require for its implementation in presently preferred embodiments the combination of several chips or controllers, or buffers, or ram arrays. FIGS. 1, 2, 3 and 4 illustrate some of these constructs or virtual machines, or aspects thereof. It is believed that a best mode of practicing these constructs or virtual machines is disclosed herein, taken together with knowledge available to anyone skilled in the art.

In FIG. 1, digital tone synthesizer 100 is comprised of memory 160, user load 171, key signal generator (KSG) 110, producing key signal(s) (KS) 111 and key signal dynamics (DYN) 112, sympathetic note signal generator (SNSG) 120 and user frequency shift variable set 172, other dynamic input 173, and other user input 174, producing sympathetic note signal(s) (SNS) 121, and digital wave generator (DWG) 130, producing digital wave(s) (DW) 131 and sympathetic digital wave(s) (SDW) 151, and digital mixer 140, all to produce sympathetic digital wave output (SDWO) 150.

Of the several (DWG) 130 illustrated in digital tone synthesizer 100, one of them responds to (KS) 111 and optional (DYN) 112 from (KSG) 110 to produce (DW) 131. A second (DWG) 130 can simultaneously respond to (SNS) 121 from (SNSG) 120 and optional (DYN) 112 from (KSG) 110 to produce (SDW) 151. (SNS) 121 is produced from (SNSG) 120 responsive to at least one sympathetic note signal generator input such as (KS) 111, (DYN) 112, user frequency shift variable set 172, other dynamic input 173, or other user input 174. The (DW) 131 and (SDW) 151 are combined in digital mixer 140 to produce a summed digital wave output 150. Digital note data is stored in memory 160 and optionally loaded by the user at 171, such as by CDROM. Input 172 is schematic of user settings that relate to the amount and degree of frequency shift that is to occur in playing any or all of the sympathetic note data streams available when played as sympathetic notes and not as primaries. This is to accommodate observed changed frequency characteristics when a given note is played as primary or when it responds sympathetically.

The key signal 111 can be the musical note value of a depressed piano key, and the key signal dynamics 112 can be the envelope and/or dynamic information related to the key signal and how fast, how firm, or how hard it was depressed. The digital wave generator 130 can be an analog synthesizer unit, or a digital wave look up table, or the DRAG/DRAM combination disclosed herein. The digital wave is thus the "primary" note elsewhere discussed herein. It may be noted in passing, by way of illustrating the application of specific hardware to these virtual machines, for example that the digital wave generator 130 might actually comprise portions of the herein disclosed DRAG, DRAM and DSP.

The sympathetic note signal generator 120 can be a calculation engine, or a look up table (also see FIG. 2) for generating a sympathetic note signal 121 such as a note value related to the key signal as sympathetic and primary notes. Within one or the other digital wave generators 130, the processing of either an sympathetic note signal or a key signal are substantially the same, so that the sympathetic digital wave 151 is a digital wave for instance read from memory much like the primary note digital wave.

Figure 2:
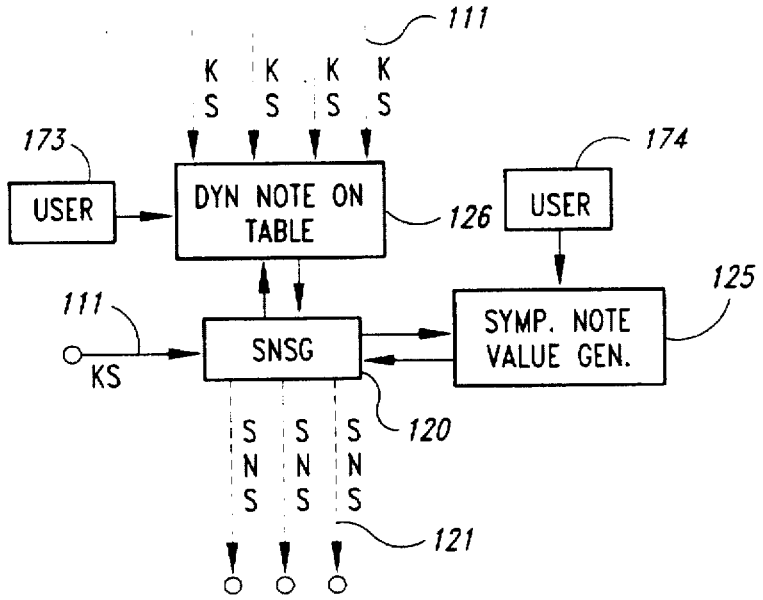
FIG. 2 is a block diagram of a detail of FIG. 1.

In FIG. 2, sympathetic note signal generator SNSG 120 is further comprised of sympathetic note value generator 125 and dynamic notes on table 126. Sympathetic note value generator 125 is the construct wherein is embodied the options of look up table or calculation engine. Any of the options or variables disclosed herein may be applied as user input to the sympathetic note value generator 125 to vary the selection of corresponding sympathetic note value(s) for a key signal input, either directly by affecting the choice from among available sympathetic notes, or indirectly by curtailing or otherwise preselecting which if any notes will be available as sympathetic notes to that primary or any other primary. A useful adjunct in this regard is dynamic notes on table 126. Table 126 which may be any conventional digital database stores dynamically which notes are currently "on" anywhere in the system, or are depressed on the key board, or are other wise undamped (such as for instance the corresponding upper notes on a piano keyboard which are always physically undamped). With this set up then, it becomes even more possible to richly vary tone synthesis by artistically selecting and playing sympathetic notes along with one or more primaries.

Figure 3:
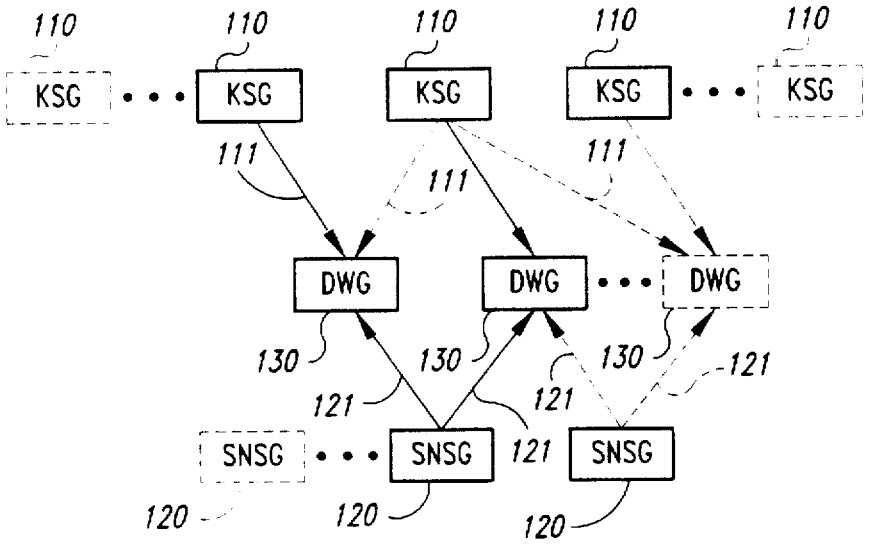
FIG. 3 is a block diagram of an alternate embodiment to that shown in FIG. 1.

FIG. 3 is a schematic illustration of dynamic allocation of digital wave generators 130 to simultaneous task as required. Any given digital wave generator can receive and process input from a number of both key signal generators 110 and sympathetic note signal generators 120, particularly if the digital wave generator in physical reality is the disclosed combination of DRAG, DRAM and DSP. The point is, it may sometimes be desirable to predesignate a particular digital wave generator for use by some particular key signals or sympathetic note signals, but it is not necessary. It also illustrates that a particular DSP need not be limited to any particular number of notes, whether preassigned or not.

Figure 4:
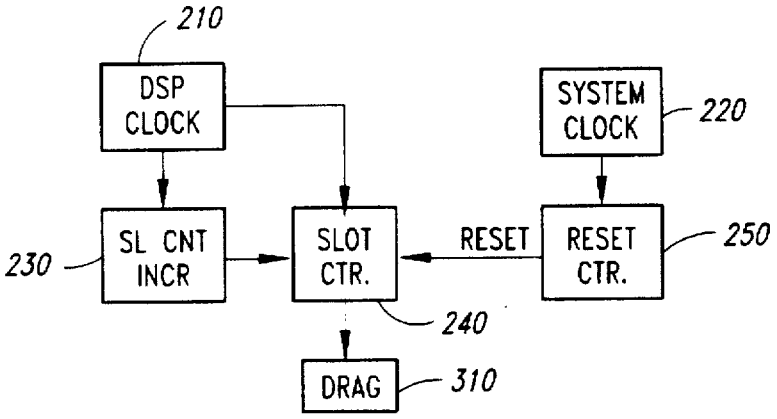
FIG. 4 is a block diagram of a detail of another aspect of the invention.

In FIG. 4, a slot timer is comprised of DSP clock 210, system clock 220, slot increment counter 230, slot counter 240, and reset counter 250. In conjunction with FIG. 6, it can be seen that time slots 610 may be counted and incremented in conjunction with DSP clock 210 running at 40 MHZ for instance. Every 8 clock ticks cause slot count incrementer 230 to increment the slot count running in slot counter 240 every 200 nS. Slot counter 240 in turn is in communication with DRAG 310 so it knows which slot is operative. When slot counter 240 reaches a predetermined maximum number of slots, for instance 112, such as by internal comparison, or by counting overall ticks from clock 210, it stops incrementing. This corresponds to the combined time duration of slots 610 or the sum of slots 611 and 612. Meanwhile concurrently running system clock 220 (generally not the same as the CPU level system clock) has a time base related to the sampling frequency, for instance 44.1 KHz. It communicates with a reset counter 250 for counting a sample period of in this case about 22.7 μS, corresponding to the wave pulses at the top of FIG. 6. When counter 250 has counted a full sample period, it sends a reset signal to slot counter 240 causing it to start counting again at slot 0; this corresponds to reset point 630 in FIG. 6. Clock 220 may conveniently run at some multiple of the sampling frequency, such as 11.290 MHZ which is 256·44.1 KHz.

Conventional piano module outputs have, among other limitations, to process simultaneously (and usually through a single DSP) all of the instantaneous note output of the module. With an instrument having the dynamic range of a piano, this creates limitations in headroom and dynamic range processing that severely detract from the verisimilitude of the note playback. To achieve improvement over conventional piano module outputs, in the invention no more than 6 preassigned notes are output to any one DSP.

Key to the digital tone synthesizer's ability to sustain 88 or more notes simultaneously is the invention concept of "Time Slots". Every note value has an associated time slot. In operation, the DSPs are fed note "data" continuously for every note (even if the note is "idle" or "off", in which case the "data" is a null). During this "idle", the DRAG just adds 0 (zero) to the address, so the address does not change, i.e. remains "static". It will be appreciated that note data only comes from DRAM 312, so the means by which the data change and thereby "generate" or read the note data is by a series of address changes from DRAG 310 to DRAM 132. These time slots are described in detail in the following section in conjunction with FIG. 6.

There are two asynchronous timing loops in effect during the operation of the digital tone synthesizer. That is, the sampled note data has an associated time base by the nature of being sampled data, and the note data samples are preferably taken at a sampling frequency of 44.1 KHz. Therefore the sample period is $1/44.1$ KHz, or about 22.7 μS. The preferred apparatus sustains all 88 notes of a full piano keyboard simultaneously so that during any sample period duration, all 88 notes are able to be turned on. Some time is also allowed for refreshing DRAM, as will be appreciated by those skilled in the art, and this has been calculated to be 2 cycles for every sample period.

In addition to accepting sample note data, the DSPs also read coefficient data for each new event. It has been determined that, at this time in development, a practical maximum of six notes can be processed by a single DSP. At this time then at least 15 DSPs (88/6) are employed to satisfy the processing requirements. Since the real performance bottleneck in the system at present exists in the rate at which MIDI events can enter the system, each DSP presently will only need to read one Coef from its coefficient FIFO during each sample period. Thus, there are only an additional 16 time slots required beyond the already discussed 88+2, bringing the total to 106 slots.

In this case the DSP processors run at 40 MHZ and are therefore asynchronous with respect to the preferred note data sample rate (indeed it is anticipated that any given DSP processor clock rate is likely to be asynchronous with any given conventional note data sample rate). Note data must therefore be "synchronized" with 40 MHZ for processing by the DSPs, but it must still be output from the DSPs at the sample frequency, as will be appreciated by those skilled in the art (hence reference herein to two asynchronous timing loops). In the invention, this is accomplished by time slicing the sample period into "time slots" which are based on 40 MHZ (or whatever the DSP clock rate is for the system). Preferred embodiments employ a resynchronizing circuit to allow for time slots that are multiples of the 40 MHZ clock (preferably 8 clocks, or clock multiples, for a 200 nS slot) to satisfy the DSPs, and yet be resynchronized to the sample data frequency at the end of every sample period.

Figure 6:
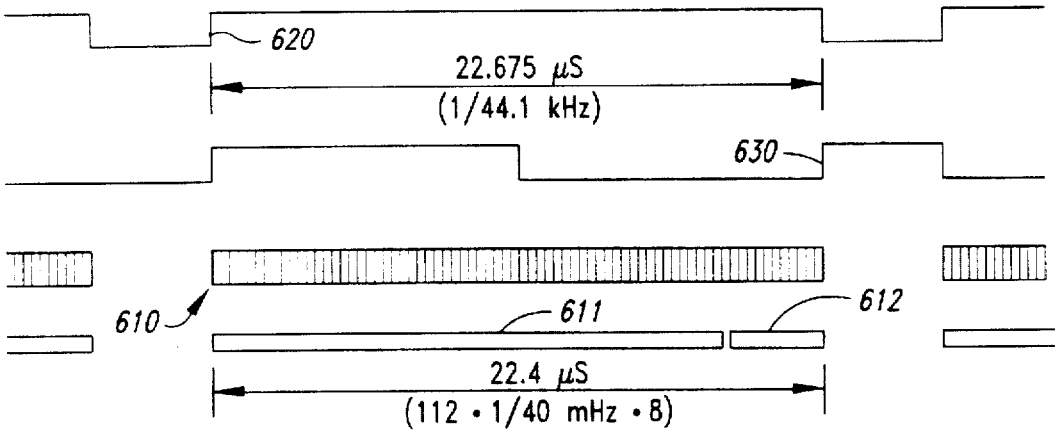
FIG. 6 is a timing diagram of a n aspect of the invention.

The preferred slot time is therefore 200 nS (8·40 MHZ clock ticks), with 112 slots/sample period (88 notes+2 refresh+16 coefficient+6 "spares"). The "spares" are available to get more coefficient data for selected DSPs if deemed necessary or beneficial. FIG. 6 illustrates a Slot Time diagram for reference. Note that 112 time slots·$1/40$ MHZ·8= 22.4 μS. Thus, with 112 time slots 610, the SLOT_COUNT will increment from 0 to 111 and wait for system clock reset pulse 630 from the sample clock timer. Note that the time required for SLOT_COUNT to reach 111 from slot counter enable pulse 620 is 22.4 microseconds, and the sample period is about 22.7 microseconds, leaving about 300 nS to spare. It would therefore be possible to have at least 113 slots with this timing configuration, with only 100 nS for resynchronizing, but 300 nS allows a margin greater than the duration of one 200 nS slot. The first 96 slots (0–95) are for note slots 611 (leaving 8 spares with respect to the 88 note keyboard). Slots 96–111 are for coefficient slots 612 and are used to transfer Coefficient Data from the FIFOs to the DSPs.

During coefficient slots 612, note sample storage DRAM 312 on the DRAG module will be refreshed. As mentioned above, there will be 96 note time slots 611. Since each time slot is comprised of 8·40 MHZ clock periods, this provides 8 states in which to generate an address, check the address against an END_ADDRESS and issue the address to note DRAM 312. The process of retrieving a note sample and sending it off to the DSP modules is actually a pipelined operation, as more fully discussed below with respect to FIG. 7.

In note slot (n), DRAG 310 finds that its start bit has been set and begins producing sequential addresses to note DRAM 312 at the rate of one address every sample period. The valid multiplexed address for note (n) will be presented to note DRAM 312 in note slot (n+1), at which time valid note data is read and sent to a DSP 410. The DSP module responsible for the particular note sample reads the note data in note slot (n+2). There is sufficient time to catch up and flush the pipeline at the end of the note slot time. This is illustrated in the timing diagram of FIG. 7.

Figure 14:
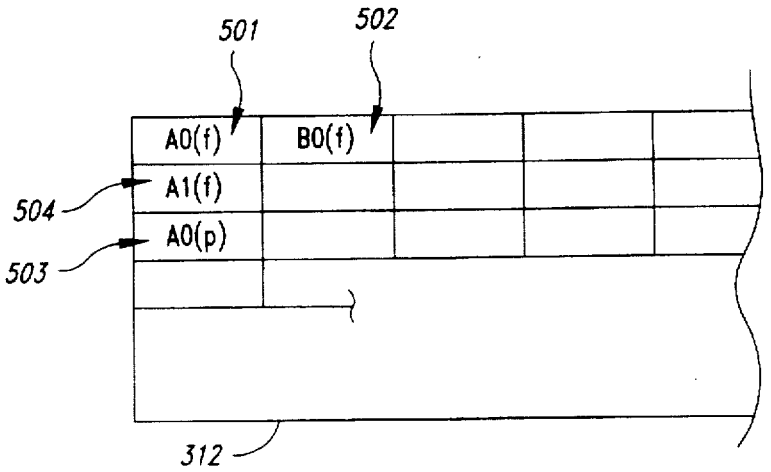
FIG. 14 is a schematic illustration of note data storage location in RAM.

FIG. 14 illustrates schematically at least one preferred storage scheme for note data in RAM. Note data A0(f) 501 and note data B0(f) 502 reside in RAM 312, followed by note data A1(f) 504, all of which are digital samples of forte piano notes. Note data A0(p) 503, elsewhere in RAM 312 is one of many digital samples of piano piano notes.

Figure 7:
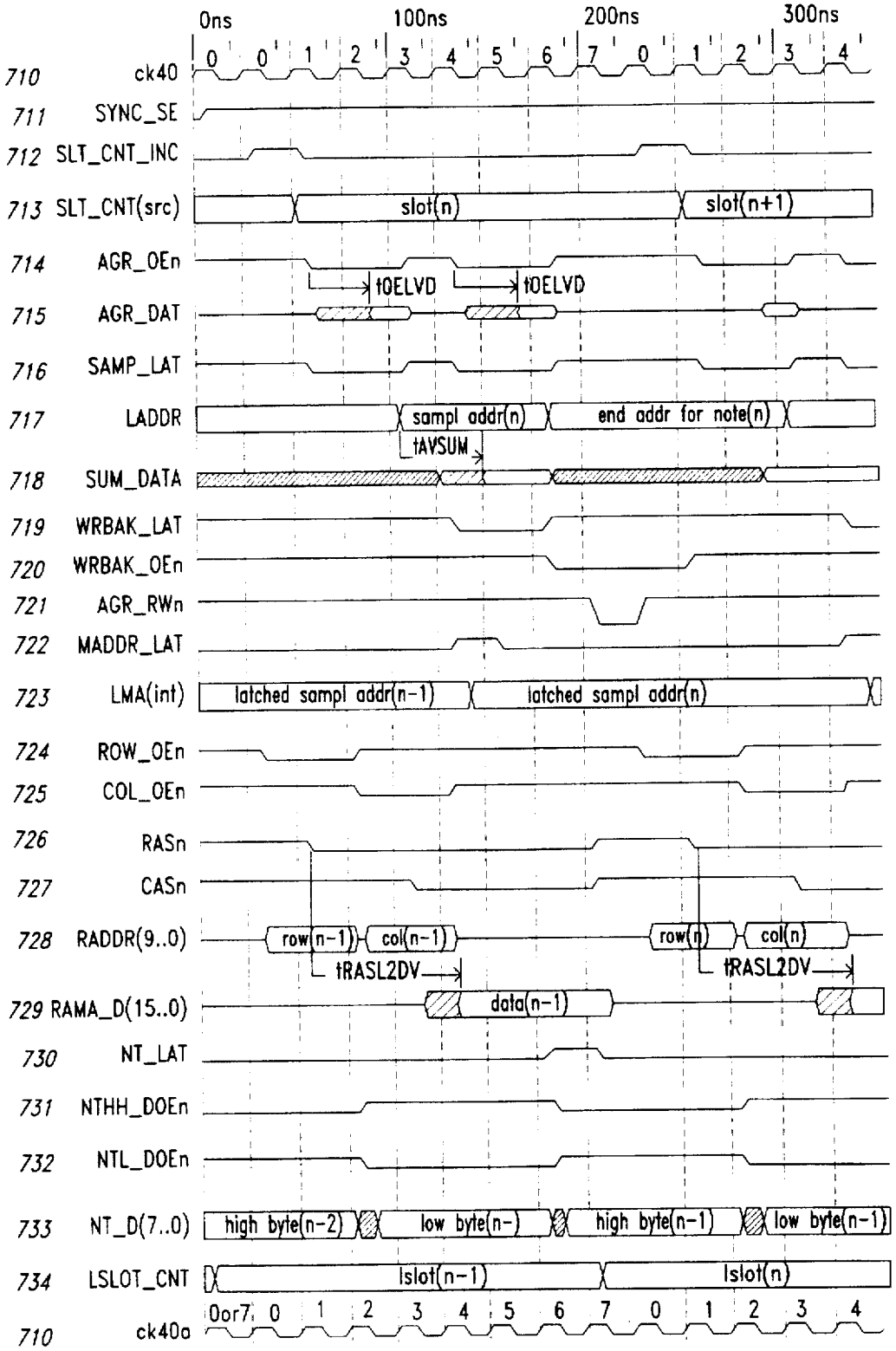
FIG. 7 is a timing diagram of sequence of events in address generation and data retrieval.

In FIG. 7 the timing diagram shows the pipelined sequence of events which occur during the address generation and data retrieval operations (also see FIGS. 8 and 9), which include 40 MHz clock pulse 710, SYNC_SE 711, SLT_CNT_INC 712, SLT_CNT(src) 713, AGR_OEn 714, AGR_DAT 715, SAMP_LAT 716, LADDR 717, SUM_DATA 718, WRBAK_LAT 719, WRBAK_OEn 720, AGR_RWn 721, MADDR_LAT 722, LMA(int) 723, ROW_OEn 724, COL_OEn 725, RASn 726, CASn 727, RADDR(9 . . . 0) 728, RAMA_D(15 . . . 0) 729, NT_LAT 730, NTH_DOEn 731, NTL_DOEn 732, NT_D(7 . . . 0) 733, and LSLOT_CNT 734, the detailed operation of which and the meaning of the signal name abbreviations will generally be familiar to those skilled in the art. Note particularly that the latched slot count LSLOT_CNT and the note data (NT_D(7 . . . 0)) are actually aligned at the DSP module input, tho they are off by one slot when leaving the DRAG.

As can be seen in Table 1, each time slot is divided into eight states. For every note and coefficient time slot, the control signals used to generate the addresses, write data to the coefficient FIFOs, and transfer data to the DSPs are based on the synchronous sub-states of the time slots. Table 1 lists the slot definitions and states and what events occur at each state for note and coefficient slots, all as will be appreciated by those skilled in the art. As can be seen from the table, some events overlap slots due to the pipelined nature of the data flow. Note that Table 1 refers to the slots at the DSP module.

Because, in addition to the activating the fundamental, a single key press is able to also activate several sympathetic notes, the amount of data sent to the DSP modules during a single event can be up to 880 bytes (say, approximately 10 notes·22 coefficients per note·4 bytes per coefficient=880 bytes). Since it is possible that all the notes (6 maximum in preferred embodiments) in a single DSP may be turned on for an event, the FIFOs hold at least 6·22·4=528 bytes of data. This of course assumes that the FIFO has not been read by the time all the coefficients have been written, which will generally not be the case.

A conventional PC data bus is 16 bits wide so each coefficient word will require two write cycles (wider data paths will dictate write modifications that are within the knowledge of those skilled in the art). Thus the coefficient data are written by the Host as 16 bit values (at least in 16 bit systems, though operation in 32 and 64 bit systems is contemplated as well) going to unique address locations. Each DSP retrieves one long word (4 consecutive bytes) of coefficient data from its FIFO during its allocated coefficient slot time (see FIG. 6). The data is always sent in whole words (4 bytes) and is sent in the order indicated in Table 2 below.

TABLE 2

| 15–8 | 7–0 | |
|---|---|---|
| CVR | HI byte | send first |
| MID byte | LO byte | send second |

This will result in the Coefficient Data being in the DSP in the form shown in Table 3.

TABLE 1

SLOT DEFINITIONS AND SLOT STATES

| Slot# | 0 | 1 | 2 | 3 | 4 | 5 | 6 | 7 | 0 |
|---|---|---|---|---|---|---|---|---|---|
| 0–87 Notes | NoteAddr (n) to AG, Row Addr (n − 1) Hi byte (n − 2) at DSP | NoteAddr (n) to AG, Row Addr (n − 1) Hi byte (n − 2) at DSP | NoteAddr (n) to AG, Column Addr (n − 1) Lo byte (n − 2) at DSP | NoteAddr (n) to AG, Column Addr (n − 1) Lo byte (n − 2) at DSP, (W) DSP host port | NoteAddr (n) to AG, Data (n − 1) valid, Lo byte (n − 2) at DSP | NoteAddr (n) to AG, Data (n-1) valid, Lo byte (n − 2) at DSP | NoteAddr (n) to AG, Data (n − 1) valid, Hi byte (n − 1) at DSP | NoteAddr (n) to AG, Data (n − 1) valid, Hi byte (n − 1) at DSP, (W) DSP host port | NoteAddr (n + 1) to AG, Row Addr (n − 1) Hi byte (n − 1) at DSP |
| 88–89 Refresh | All CASn driven | Hold | All RASn driven | Hold | Hold | All CASn released | All RASn released | Hold | All CASn driven |
| 90–95 spare | increment slot count | slot count valid | slot count valid | slot count valid | slot count valid | slot count valid | slot count valid | slot count valid | increment slot count |
| 96–111 Coef | (R) FIFO byte 3 low data, slot (n − 1) | (W) DSP host port, byte 3, slot (n − 1) | (R) FIFO byte 0 (CVR), slot (n) | (W) DSP host port, byte 0, slot (n) | (R) FIFO byte 1 high data, slot (n) | (W) DSP host port, byte 1, slot (n) | (R) FIFO byte 2 mid data, slot (n) | (W) DSP host port, byte 2, slot (n) | (R) FIFO byte 3 low data, slot (n) |
| idle time | slot counter idle | | | | | | | | |

Notes are grouped per DSP such that DSP0 has Notes 0–5, DSP1 has notes 6–11, and so on (see also Table 5). The first 8 DSPs all preferably have 6 notes each, and the last 8 DSPs preferably have 5 notes each. The last 8 DSPs therefore have note time slots for unused notes which allows for 8 free sounds if needed. Coefficient data for a particular new note is written to the Coef FIFO corresponding to the DSP that will be processing the new note. A new note event generally requires up to 22 coefficients for each note that will be activated.

TABLE 3

| Host Addr = 1 | Host Addr = 5 | Host Addr = 6 | Host Addr = 7 |
|---|---|---|---|
| CVR | HI byte | MID byte | LO byte |

where the CVR is the Host interrupt vector and contains the note number of the coefficient data; and HI, MID, and LO bytes are the bytes of the 24 bit coefficient word. What is actually sent to the DSP FIFOs is a bytewide stream of data, with the encoded DSP number and the note number within that DSP going out first as the CVR (this DSP/note address is actually the low order address bits that the Host writes to). The LO byte is the last byte written to the Host port of the DSP because writing that byte transfers the word from the DSP registers to internal memory.

A newly activated note can not be sent from the DRAG module to the DSP module until the proper event coefficients have been completely transferred to the DSP processor(s) which are working on the new note. In order to synchronize the note data with the proper coefficient set, a "Note Turn-On" bit will be sent back to the DRAG module when the last coefficient has been read from the coefficient FIFO The Note Turn-On bit will be in the CVR and will be used to tell the control logic on the DRAG module that the current 4 byte coefficient word is the last one for the pending note and the changing note data can now be sent down from the DRAG module to the DSP module. Data for the CVR will depend upon whether the coefficient block associated with that CVR is a normal one or the last one. Thus there are two different CVR bytes for each note; one with the bit cleared (normal coefficient), and one with the bit set Cast coefficient). See Tables 4 and 5 below for CVR values.

The data format for the normal CVR is shown in Table 4 below.

TABLE 4

| bit | 31 | 30 | 29 | 28 | 27 | 26 | 25 | 24 |
|---|---|---|---|---|---|---|---|---|
| val | 0 | 0 | 0 | 0 | 0 | n2 | n1 | n0 |

The data format for the last CVR is shown in Table 5 below (bit 27 is set to 1).

TABLE 5

| bit | 31 | 30 | 29 | 28 | 27 | 26 | 25 | 24 |
|---|---|---|---|---|---|---|---|---|
| val | 0 | 0 | 0 | 0 | 1 | n2 | n1 | n0 |

Where n2 n1 n0 specifies the note within the DSP. Valid range is 0–5 (binary).

Bit 27 which is set in the CVR causes a I to be loaded into the DRAG Dual Port RAM. This "turns on" the note because the "I" becomes the increment value for the sample address of the pending note. Therefore, upon receiving the note turn-on bit, the address generator on the DRAG starts fetching data values from the DRAM look-up table. However, the CPU always has access to the DRAM to turn off notes, reset the notes, or to start the notes from a non zero state.

In DSP operation (also see FIG. 8), during note time (0<SLOT_COUNT<95), note data and SLOT_COUNT is transferred from the AG to the DSP modules on the NoteBus. The SLOT_COUNT is latched and decoded to determine which DSP should receive the incoming data (see FIG. 9). A conventional state machine generates the necessary timing signals to load the DSP Host port with the note data in accordance generally with FIG. 7. Even if a note has not been activated, the data (will=0) is still written to the DSP. This allows up to 96 note samples to be transferred during each sample period.

During coefficient time (96<SLOT_COUNT<111), coefficient data is read by the DSPs from their corresponding coefficient FIFOs. Each DSP reads a block (4) of coefficients during its allocated time slot. SLOT_COUNT 96 is used by DSP0 and so on up to SLOT_COUNT 111 for DSP15. As above, the SLOT_COUNT is decoded and the control signals are generated by the state machine to transfer coefficient data from the FIFO to the Host port of the DSP.

For each coefficient slot time, the NoteBus is tri-stated by the DRAG so that it can be used to send note activation information from the DSP modules back to the DRAG module. During the second half of the slot (the latter 100 nS), the NoteBus is driven with the CVR read from the FIFO. If the turn-on bit is set, the AG logic will set the increment bit to I and the Note will be activated in its next time slot.

It happens that there are a few nanoseconds of dead time while the SLOT_COUNT gets resynchronized with the Sample Rate clock (44.1 KHz) (see FIG. 6). During this time, no transfers take place, but the DSPs continue to process data, and the Host CPU can continue to parse MIDI commands and send coefficients to the FIFOs.

Table 7 below lists the offset addresses from the DSP base address which will be required. For now, the base address will be assumed to be as DSP_BASE, so all of the addresses that follow will be added to DSP_BASE. Table 6 is a summary of memory usage for the Table 7 addresses.

TABLE 6

| | | CPU Address | | | | | | | | | |
|---|---|---|---|---|---|---|---|---|---|---|---|
| Memory Region | Qty.. | A9 | A8 | A7 | A6 | A5 | A4 | A3 | A2 | A1 | A0 |
| DSP (n) Host Port | 128 | 0 | 0 | 0 | D3 | D2 | D1 | D0 | HA2 | HA1 | HA0 |
| DSP Status Regs | 4 | 0 | 0 | 1 | D3 | D2 | x | x | x | x | x |
| DSP Control Regs | 4 | 0 | 1 | 0 | D3 | D2 | x | x | x | x | x |
| Write FIFOs | 16 | 0 | 1 | 1 | D3 | D2 | D1 | D0 | x | x | x |

TABLE 7

| Memory Region | Function | CPU Addr (9 . . . 0) | | Size | Acc |
|---|---|---|---|---|---|
| DSP0 Host Port | CPU access to DSP Host Port registers 0–7 | 000 | 007 | 8 | R/W |
| DSP1 | CPU access to DSP Host Port registers 0–7 | 008 | 00F | 8 | R/W |
| DSP2 | CPU access to DSP Host Port registers 0–7 | 010 | 017 | 8 | R/W |
| DSP3 | CPU access to DSP Host Port registers 0–7 | 018 | 01F | 8 | R/W |
| DSP4 | CPU access to DSP Host Port registers 0–7 | 020 | 027 | 8 | R/W |
| DSP5 | CPU access to DSP Host Port registers 0–7 | 028 | 02F | 8 | R/W |
| DSP6 | CPU access to DSP Host Port registers 0–7 | 030 | 037 | 8 | R/W |
| DSP7 | CPU access to DSP Host Port registers 0–7 | 038 | –3F | 8 | R/W |

TABLE 7-continued

| Memory Region | Function | CPU Addr (9 . . . 0) | | Size | Acc |
|---|---|---|---|---|---|
| DSP8 | CPU access to DSP Host Port registers 0–7 | 040 | 047 | 8 | R/W |
| DSP9 | CPU access to DSP Host Port registers 0–7 | 048 | 04F | 8 | R/W |
| DSP10 | CPU access to DSP Host Port registers 0–7 | 050 | 057 | 8 | R/W |
| DSP11 | CPU access to DSP Host Port registers 0–7 | 058 | 05F | 8 | R/W |
| DSP12 | CPU access to DSP Host Port registers 0–7 | 060 | 067 | 8 | R/W |
| DSP13 | CPU access to DSP Host Port registers 0–7 | 068 | 06F | 8 | R/W |
| DSP14 | CPU access to DSP Host Port registers 0–7 | 070 | 077 | 8 | R/W |
| DSP15 | CPU access to DSP Host Port registers 0–7 | 078 | 07F | 8 | R/W |
| DSP Status Regs | | | | | |
| DSP(0–3)_STAT | Read DSP module status; FIFIO full flags | 080 | | 8 | R |
| DSP(4–7)_STAT | Read DSP module status; FIFIO full flags | 0A0 | | 8 | R |
| DSP(8–11)_STAT | Read DSP module status; FIFIO full flags | 0C0 | | 8 | R |
| DSP(12–15)_STAT | Read DSP module status; FIFIO full flags | 0E0 | | 8 | R |
| DSP Control Regs | | | | | |
| DSP(0–3)_CNTL | Write control bits to DSP modules; FIFO reset | 100 | | 8 | W |
| DSP(4–7)_CNTL | Write control bits to DSP modules; FIFO reset | 120 | | 8 | W |
| DSP(8–11)_CNTL | Write control bits to DSP modules; FIFO reset | 140 | | 8 | W |
| DSP(12–15)_CNTL | Write control bits to DSP modules; FIFO reset | 160 | | 8 | W |
| Write FIFOs | | | | | |
| DSP0_FIFO | Write Coef data to FIFO for DSP0; notes 0–5 | 180 | | 32 | W |
| DSP1_FIFO | Write Coef data to FIFO for DSP1; notes 6–11 | 188 | | 32 | W |
| DSP2_FIFO | Write Coef data to FIFO for DSP2; notes 12–17 | 190 | | 32 | W |
| DSP3_FIFO | Write Coef data to FIFO for DSP3; notes 18–23 | 198 | | 32 | W |
| DSP4_FIFO | Write Coef data te FIFO for DSP4; notes 24–29 | 1A0 | | 32 | W |
| DSP5_FIFO | Write Coef data to FIFO for DSP5; notes 30–35 | 1A8 | | 32 | W |
| DSP6_FIFO | Write Coef data to FIFO for DSP6; notes 36–41 | 1B0 | | 32 | W |
| DSP7_FIFO | Write Coef data to FIFO for DSP7; notes 42–47 | 1B8 | | 32 | W |
| DSP8_FIFO | Write Coef data to FIFO for DSP8; notes 48–52 | 1C0 | | 32 | W |
| DSP9_FIFO | Write Coef data to FIFO for DSP9 ; notes 53–57 | 1C8 | | 32 | W |
| DSP10_FIFO | Write Coef data to FIFO for DSP10; notes 58–62 | 1D0 | | 32 | W |
| DSP11_FIFO | Write Coef data to FIFO for DSP11; notes 63–67 | 1D8 | | 32 | W |
| DSP12_FIFO | Write Coef data to FIFO for DSP12; notes 68–72 | 1E0 | | 32 | W |
| DSP13_FIFO | Write Coef data to FIFO for DSP13; notes 73–77 | 1E8 | | 32 | W |
| DSP14_FIFO | Write Coef data to FIFO for DSP14; notes 78–82 | 1F0 | | 32 | W |
| DSP15_FIFO | Write Coef data to FIFO for DSP15; notes 83–87 | 1F8 | | 32 | W |

Figure 8:
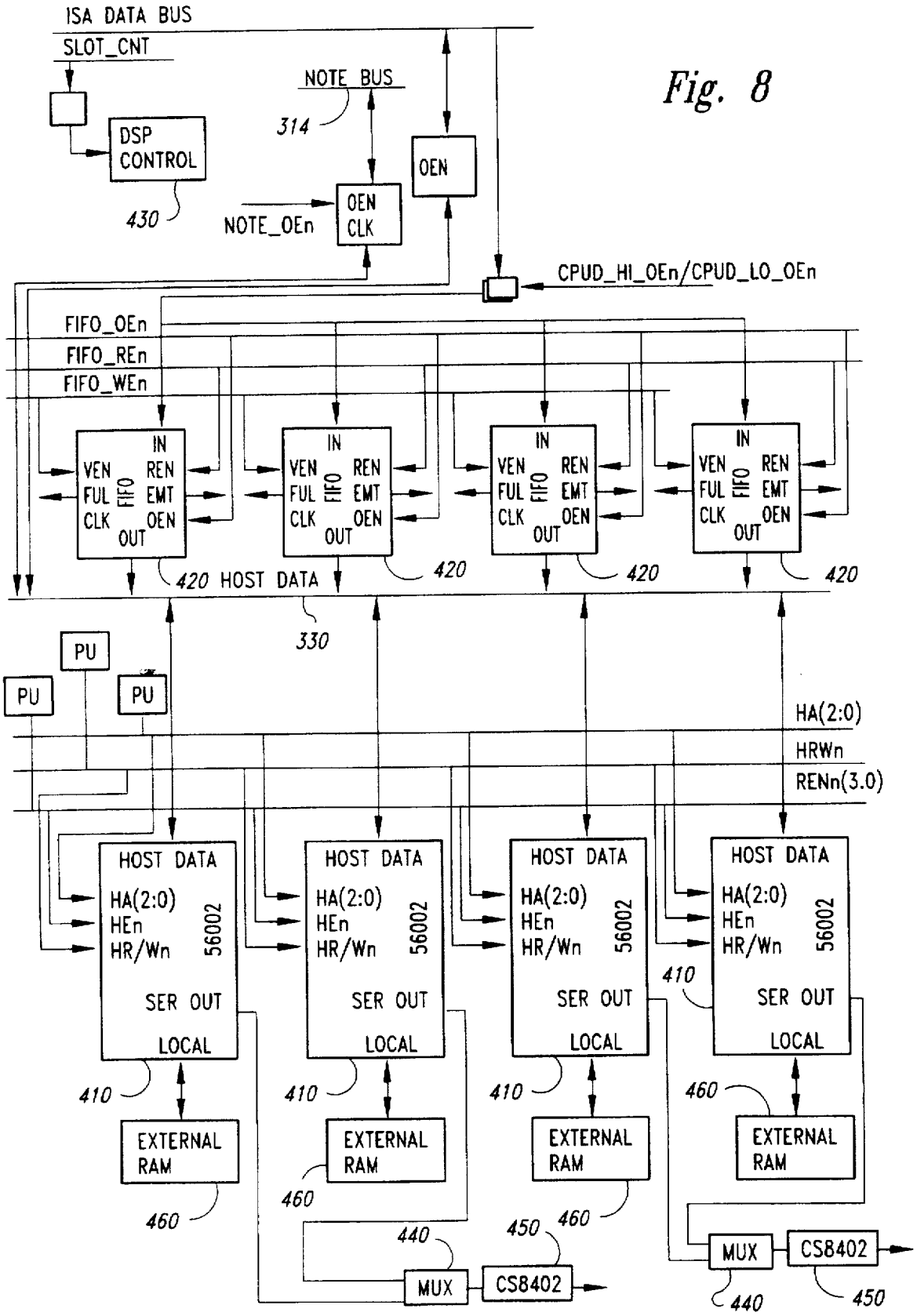
FIG. 8 is a schematic block diagram of DSP modules for the invention.
Figure 9:
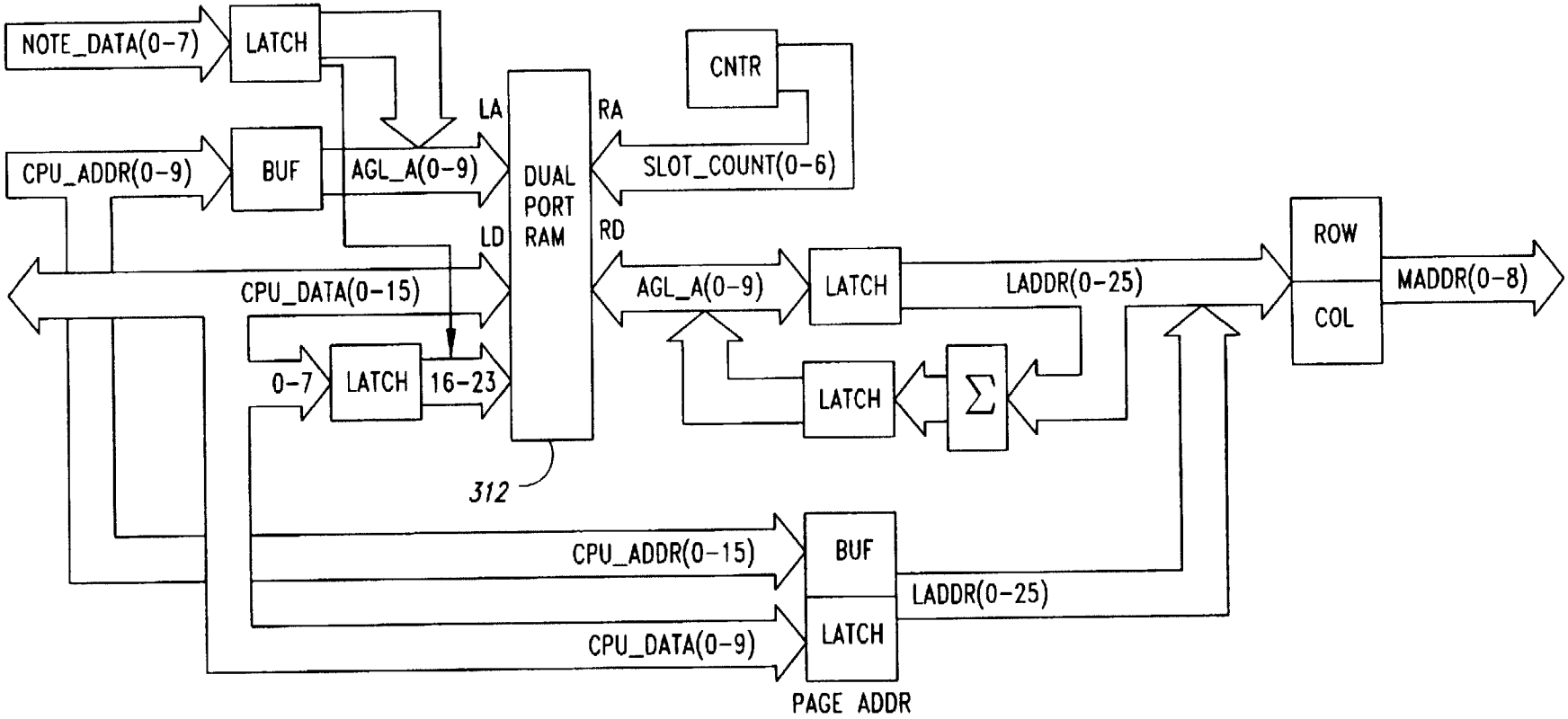
FIG. 9 is a block diagram of an address generator for the invention.

In FIGS. 8 and 9, schematic diagrams illustrating preferred data retrieval and address generation schemes are illustrated, all as will be appreciated by those skilled in the art. It is believed that the schematics of FIGS. 8 and 9 are self explanatory, however In general, FIG. 8 schematically details the layout of a DSP module board for the invention DSPs 410 have associated external, "local" RAM 460, read Coef data from FIFOs 420, read note data from host data buss 330, and output digital audio via muxers 440 and transmitters 450. DSP control 430 oversees DSP operation.

FIG. 9 illustrates latching, counting, note data transfer and address generation and address data transfer, all as discussed herein. It is believed that the details of FIG. 9 are well within the comprehension of those skilled in the art.

Figure 11:
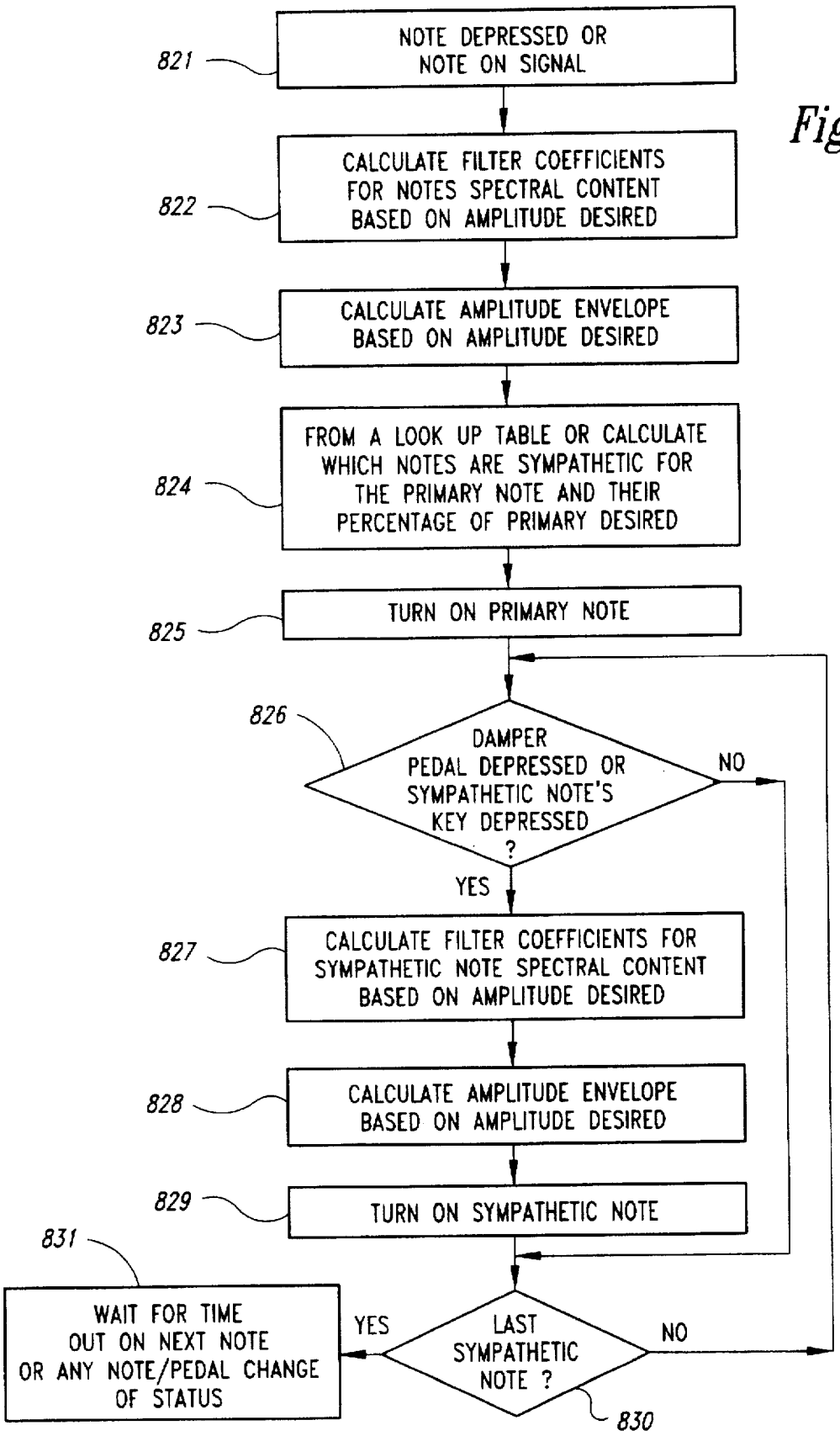
FIG. 11 is a flow chart for new event processing logic for the invention.
Figure 12:
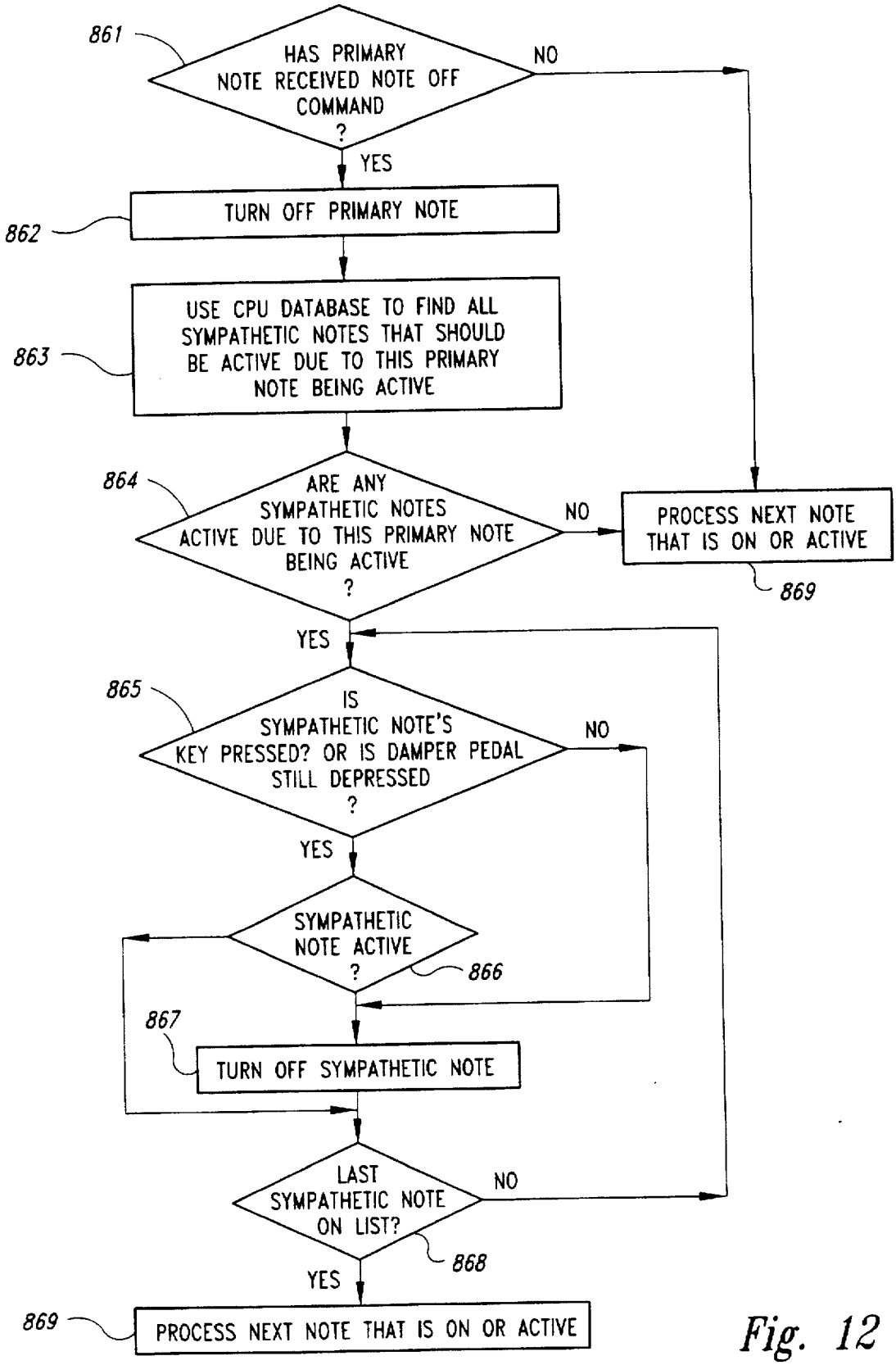
FIG. 12 is a flow chart for active event processing logic for the invention.

In FIGS. 11 and 12 the logical sequence preferred for processing all new note events and all active note events respectively is illustrated in flow chart from. Although the flow charts provide a preferred sequence of operation, steps shown in sequence may be changed to some other cycle of operation, and some steps in the preferred sequence may be eliminated, while other steps not disclosed may be added, provided that all such changes are within the principles of the operation of the invention as disclosed herein.

It will be appreciated that when a sympathetic note is activated, it will preferably start off at reduced amplitude during the attack phase of its sample. This is to minimize the incursion of the hammer sound contributed by the sympathetic note sample. In practice, the amplitude of the sympathetic sample is simply ramped up (by such conventional means as will occur to those skilled in the art) to optimum dynamic level after the hammer sound has disappeared. At the same time preferably, primary notes have their amplitudes increased whenever the damper pedal is down because some of the sympathetic notes vibrate at the primary notes' own frequency, in addition to what ever other individual modes they also vibrate at, thus potentially overshadowing the primary note in the resulting mix.

FIG. 11 is a flow chart for "new event" processing logic. It is believed that the flow charts of FIGS. 11 and 12 are self explanatory, however at step 821 logic checks for either a note on signal or a note otherwise depressed. At step 822, for every note on detected, filter coefficients for desired note spectral content, including based on amplitude are calculated, followed at step 823 by calculation of the appropriate amplitude envelope coefficients. At step 824 appropriate sympathetic note values are either retrieved (read) from a stored look up table, or calculated for the particular primary note on signal, together with an indication of the percentage of their primary value desired. At step 825, the actual primary note is read from DRAM via DRAG address sequencing as discussed above. At branch 826 a loop begins, first checking if the damper pedal, or any of the corresponding keys for the now designated sympathetic notes, is depressed. If not, the loop is exited by jumping to just ahead of branch 830; if so, then the loop proceeds to steps 827 and 828. There filter coefficients for desired sympathetic note spectral content, including based on amplitude are calculated, followed at step 828 by calculation of the appropriate amplitude envelope coefficients for the sympathetic notes. At step 829 the sympathetic note is turned on by reading from DRAM via DRAG address sequencing as discussed above. At branch 830 logic checks to see if the last sympathetic note to be activated for this primary has been activated, and if not the loop repeats until it has. The loop then terminates at step 831 where a time out is awaited or any note or pedal status change.

FIG. 12 is a flow chart for active primary note processing logic. At branch 861 logic checks to see if any active primary note has received a note off command. If not, the logic jumps to step 869 and the next active primary note is checked. If a primary note has received a note off command, than at step 862 the primary note is turned off. At step 863 the database is checked to find all sympathetic notes that were to have been activated for this primary note. If none of the appropriate sympathetic notes are then active, at branch 864 the logic jumps to step 869 and the process terminates for that primary note. If any sympathetic notes are still active, then at branch 865 logic checks to see if either the sympathetic note's key is still depressed or the damper pedal is depressed. If not, and the note is timed out, the sympathetic note is turned off at step 867; if so, then at branch 866 logic checks to see if the sympathetic note is still active. If not, the logic jumps to just ahead of branch 868 to check if it is the last sympathetic note on the current list. If at branch 866 the sympathetic note is no longer active, it is turned off at step 867, and branch 868 is checked. If the note is not the last on the list, a loop is repeated back to just before step 865. If it is the last note, then at step 869 the logic terminates and the next note that is on or active is checked.

With regard to systems and components above referred to, but not otherwise specified or described in detail herein, the workings and specifications of such systems and components and the manner in which they may be made or assembled or used, both cooperatively with each other and with the other elements of the invention described herein to effect the purposes herein disclosed, are all believed to be well within the knowledge of those skilled in the art. No concerted attempt to repeat here what is generally known to the artisan has therefore been made.

INDUSTRIAL APPLICABILITY

The invention will find application in the music industry wherever digital grand pianos are presently used. In addition, the invention may be employed in performance and concert applications where new and greater ranges of expressive capability may be required in instrumentation.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. A digital tone synthesizer having stored digitally sampled note data, the note data having been sampled at a sampling frequency F, with a sample period of 1F, the digital tone synthesizer comprising:

a DSP clock operating at a DSP clock frequency;

a slot count incrementer for incrementing in a slot counter a slot count of a selectable number of slots n, each slot having a slot duration defined by a selectable number of DSP clock ticks T;

a system clock operating at a system clock frequency equal to a whole number P multiple of the sampling frequency, the system clock producing system clock ticks;

a reset counter for counting P system clock ticks and thereupon effecting a reset signal to the slot counter.

2. The apparatus of claim 1 wherein the number of DSP clock ticks T is 8 and the DSP clock frequency is 40 MHZ.

3. The apparatus of claim 2 wherein the slot count is comprised of a note count and a coefficient count and the sampling frequency F is 44.1 KHZ and the number of slots n is 112.

4. In a digital tone synthesizer having digitally stored musical waveform data, a slot timer for simultaneous access to multiple data addresses comprising:

a DSP clock operating at a DSP clock frequency;

a slot count incrementer for incrementing in a slot counter a slot count of a selectable number of slots n, each slot having a slot duration defined by a selectable number of DSP clock ticks;

a system clock operating at a system clock frequency F, the system clock producing system clock ticks;

wherein the slot timer is in communication with an address generator for accessing musical waveform data addresses in memory so that each waveform in memory has an associated time slot, and so that the address generator knows which slot is operative.

5. The apparatus of claim 4 wherein the address generator is continuously cycling.

6. The apparatus of claim 4 further comprising a resynchronizing circuit for resynchronizing the slot count to the frequency F every period 1/F, the circuit comprising a reset counter for counting a predetermined number of system clock ticks and effecting a reset signal to the slot counter.

* * * * *